US008539718B2

(12) United States Patent
Ziegler

(10) Patent No.: US 8,539,718 B2
(45) Date of Patent: Sep. 24, 2013

(54) RAIN CATCH FOR COLLECTING AND DIVERTING RAINWATER FROM A RETRACTABLE AWNING

(76) Inventor: Tom Ziegler, Canton, MI (US)

( * ) Notice: Subject to any disclaimer, the term of this patent is extended or adjusted under 35 U.S.C. 154(b) by 19 days.

(21) Appl. No.: 13/009,107

(22) Filed: Jan. 19, 2011

(65) Prior Publication Data

US 2012/0180892 A1 Jul. 19, 2012

(51) Int. Cl.
*E04D 13/00* (2006.01)

(52) U.S. Cl.
USPC ..... 52/11; 52/15; 52/16

(58) Field of Classification Search
USPC ..... 52/73, 302.1, 11, 12, 3, 15, 16; 135/32.2, 135/48; 280/6.153
See application file for complete search history.

(56) References Cited

U.S. PATENT DOCUMENTS

| | | | | |
|---|---|---|---|---|
| 2,814,529 | A | 11/1957 | Arut | |
| 2,898,939 | A | 8/1959 | Fox | |
| 3,375,851 | A | 4/1968 | Henry et al. | |
| 3,612,453 | A | 10/1971 | Zimmer | |
| 3,934,924 | A | 1/1976 | Diliberti | |
| 4,160,458 | A | 7/1979 | Marcellus | |
| 4,622,785 | A | 11/1986 | Miller | |
| 5,358,007 | A | 10/1994 | Carlberg | |
| 5,435,051 | A | 7/1995 | Cheremshynski | |
| 5,865,498 | A | 2/1999 | Grogan | |
| 5,960,591 | A | 10/1999 | Schluter | |
| 6,123,090 | A * | 9/2000 | Wescott | 135/88.1 |
| 6,223,777 | B1 | 5/2001 | Smith et al. | |
| 6,435,512 | B1 * | 8/2002 | Beckwith, Sr. | 273/407 |
| 6,612,075 | B1 | 9/2003 | Knoop et al. | |
| 6,880,295 | B2 | 4/2005 | Frey | |
| 7,677,271 | B2 | 3/2010 | Boettner et al. | |
| 2004/0163692 | A1 * | 8/2004 | Jarrett | 135/33.2 |
| 2005/0229482 | A1 * | 10/2005 | Wynn | 47/40.5 |

FOREIGN PATENT DOCUMENTS

EP 0070332 A1 1/1983

OTHER PUBLICATIONS

Web link: http://www.dippygutter.com / Downloaded Jun. 7, 2010.
Web link: http://www.mastergardening.com /too-3150.html Downloaded Jun. 7, 2010.
Web link: http://www.woodlanddirect.com /Rain-Barrel-Downspout-Diverter?partner=spc Downloaded Jun. 7, 2010.

* cited by examiner

*Primary Examiner* — Brian Glessner
*Assistant Examiner* — Paola Agudelo
(74) *Attorney, Agent, or Firm* — Russ Weinzimmer & Associates P.C.

(57) ABSTRACT

A rain catch is disclosed that collects and diverts rainwater from the perimeter of a retractable awning having an awning canopy that is tilted so as to have a lowest corner. The rain catch has a body that includes a body cavity and an awning beam collar, the body cavity having an opening that receives rainwater flowing off the lowest corner of the awning canopy. The awning beam collar is attached to the awning beam of the retractable awning at the lowest corner of the canopy. The rain catch is attached to the awning beam such that the opening of the collector body cavity is disposed in a space between the edge of the awning canopy and a bracing member at the lowest corner of the awning. The rain catch can include an extended downspout coupled to the downspout port to direct received rainwater away from the retractable awning.

18 Claims, 7 Drawing Sheets

RAIN CATCH FOR COLLECTING AND DIVERTING RAINWATER FROM A RETRACTABLE AWNING

FIELD OF THE INVENTION

This invention relates to rainwater capture and diversion, and more particularly to rainwater capture and diversion as applied to awnings.

BACKGROUND OF THE INVENTION

The use of retractable awnings has become widespread. They are commonly used to provide shelter from the elements for outdoor spaces such as patios. They can also be employed to lower energy bills by shading windows of dwellings, and are widely installed on campers and motor homes to provide protection from the elements for a patio area immediately adjacent thereto. Their retractable design is particularly important to the camper and mobile home application as it is critical that they be easily stowed while the camper or mobile home is in motion.

One important concern users of awnings have, both fixed and retractable, is control of rainwater as it sheds from the top surface of the awning. Awnings are typically deployed such that their top surfaces are declined at a downward angle from their point of attachment to a structure. This facilitates shedding of rainwater to the lower end of the awning and prevents water from pooling on the top of the awning. As with pitched roofs on buildings, without a gutter system of some kind, water can quickly pool and splash around the perimeter of the awning. This can cause problems such as erosion, mud splatter, and even flooding of the very area the awning is intended to shield from the rain.

Gutter systems of various designs similar to those employed on the roofs of buildings have been adapted for use in conjunction with awnings in the past to help collect and divert the shedding rainwater away from the perimeter of the awning. Such a gutter system, however, is really only practical when applied to awnings that are intended to be permanently (or at least semi-permanently) deployed. Any conventional gutter system design that is applied to a retractable awning will interfere with its easy retraction and stowing. At the very least, a typical gutter system would have to be detached and disassembled first every time a retractable awning is to be retracted and stowed away. Likewise, the gutter system would have to be re-assembled and re-affixed whenever the awning is re-deployed. Thus, this additional assembly and dis-assembly of a gutter system tends to negate the convenience that a retractable awning is designed to provide, and such systems are therefore not commonly used with retractable awnings.

One simple technique commonly employed by users of retractable awnings, in an attempt to minimize impact of rainwater as it is shed from the awning during a rain shower or storm, is to tilt the awning to one corner on the downward end of the awning. This at least causes the flow of the shedding rainwater to be substantially directed to one location of the awning's perimeter, rather than being permitted to shed from all downward edges of the awning. This can be accomplished by simply adjusting a supporting member, typically provided at each corner of the tilted end of the awning, such that one support member is shorter than the other. This causes the top surface of the awning to tilt to the corner having the shorter support member.

While this technique is helpful in some ways, it still does not solve the problems outlined above, and in fact may exacerbate some of them. For example, pooling of water and erosion can be much worse, albeit limited to one location, when virtually all of the rainwater is shed to a more limited area of the awning's perimeter.

SUMMARY OF THE INVENTION

An easy to install (and uninstall) rain catch collects rainwater shed from the top surface of an awning canopy of a retractable awning to facilitate the diversion of the collected water to a more convenient location other than the immediate area surrounding the perimeter of the awning. The rain catch is designed to be quickly strapped or clamped to an awning beam on the leading edge of the awning that is provided with most retractable awning designs. The rain catch is disposed at a lowest corner of the awning, established by adjusting the length of one support member of a retractable awning at that corner of the downward end of the awning to be shorter than any other members supporting the awning at its downward or leading edge.

The rain catch has a body cavity with an opening that is disposed in a spacing between a bracing member that runs substantially perpendicular to the awning beam and the side edge of the awning canopy. The rainwater is collected or captured as it flows toward the lower corner and over the edge of the awning canopy into the cavity opening. The rainwater is then funneled through a downspout port to which a downspout of adequate length and/or angle may be coupled. The end of the downspout is typically directed away from the immediate perimeter area of the awning and can be located at a sufficient distance that the problems associated with excessive water shedding from the perimeter edges of the downward side of the awning are avoided.

The rain catch and diverter is easily installed and removed from most retractable awning designs, thereby making it particularly desirable for application to retractable awnings that are intended to be only temporarily deployed, and are thus retracted and then re-deployed on a regular basis.

In one general aspect of the invention, a rain catch collects and diverts rainwater from a retractable awning. The retractable awning has an awning beam that supports a tilted awning canopy that has a lowest corner. The tilted awning canopy directs rainwater to the lowest corner. The rain catch includes a collector body that defines a collector body cavity and an awning beam collar. The collector body cavity has a cavity opening that is able to receive rainwater flowing off the lowest corner of the tilted awning canopy. The awning beam collar can be attached to the awning beam. The rain catch further includes a downspout port cooperative with the collector body that is able to couple to a downspout. The downspout port permits received rainwater to flow from the collector body, through the downspout port, and out of the downspout.

In a further embodiment, the rain catch includes means for securing the awning beam collar to the awning beam, and that in further embodiments, the means for attaching can at least one hook and loop material strap. In an embodiment, the retractable awning has a bracing member substantially perpendicular to the awning beam at each side of the awning canopy, and the cavity opening of the collector body cavity is disposed at the lowest corner of the tilted awning canopy in a space between the edge of the awning canopy and one of the bracing members. In another aspect of the collector body further comprises a mounting hole and one end of a mounting support can be inserted in the mounting hole and the other end can be in physical communication with the one of the bracing members to resist rotation of the rain catch around the awning beam.

In further embodiments, the rain catch can include an angled downspout coupled to the downspout port to direct received rainwater away from the retractable awning, and an extended downspout coupled to the downspout port to direct received rainwater away from the retractable awning. In an embodiment, the rain catch can include a means for substantially immobilizing the extended downspout at an end closest to the ground, and that means for immobilizing can be a body filled with sand and a means, coupled to the body, for securing the extended downspout to the body filled with sand.

In other aspects of the invention, the awning beam collar can include a pad made of a material able to resist rotation of the rain catch about the awning beam, and the collector body and the collector body cavity can be curved to direct rainwater flow toward the downspout port. In an embodiment, the collector body cavity can also an angled surface that can direct received rainwater flowing past the downspout port from the front of the collector body downwardly towards the downspout port.

BRIEF DESCRIPTION OF THE DRAWINGS

The invention will be more fully understood with reference to the Detailed Description, in conjunction with the following FIGURES, wherein.

DETAILED DESCRIPTION

Figure 1:
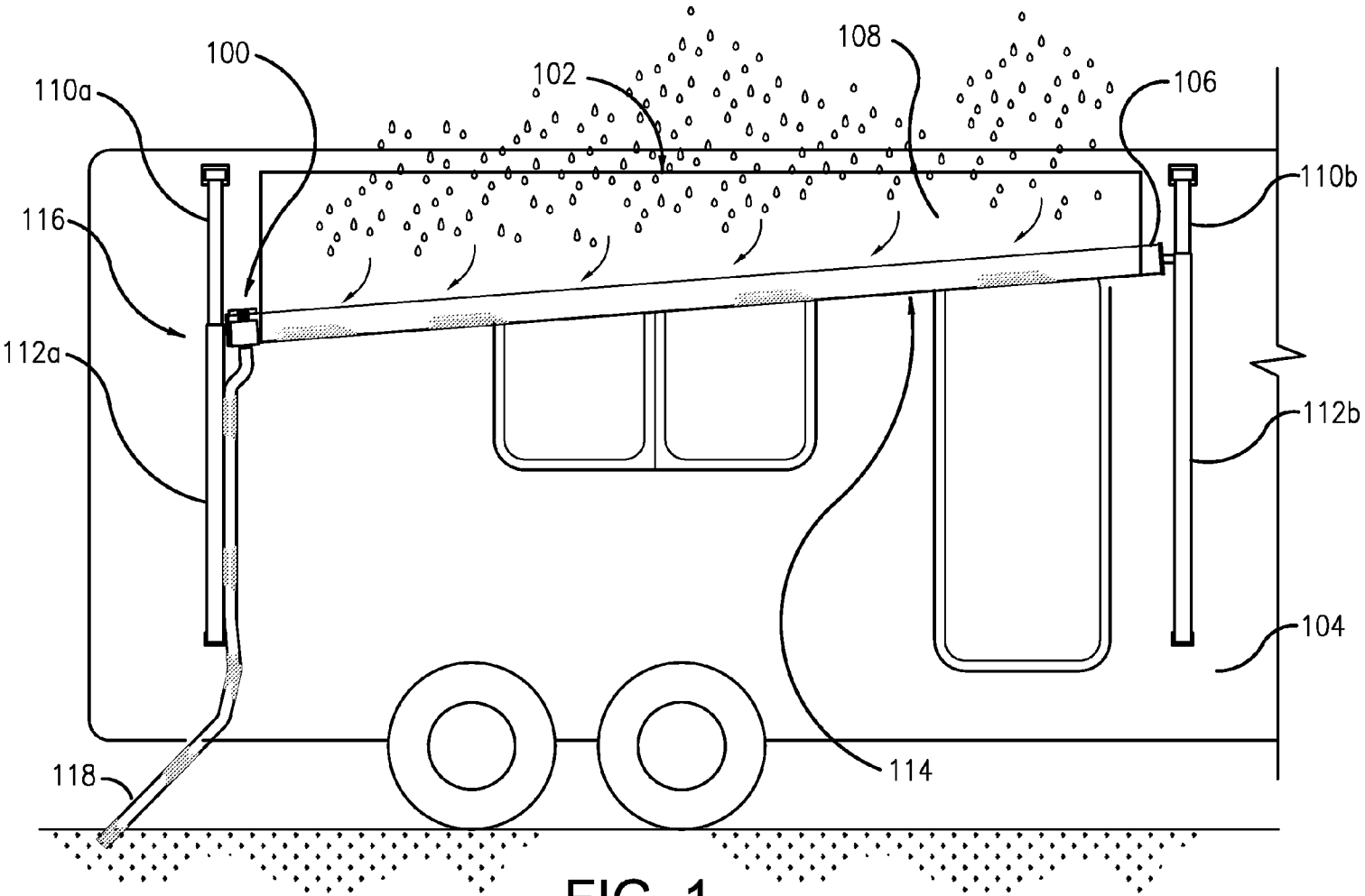
FIG. 1 is a perspective view of a retractable awning, attached to an RV or camper, with one corner of its downward side being lower than the other, and showing an embodiment of the invention operatively installed at the lower corner.

FIG. 1 is a view from the front of a retractable awning 102 that is attached to and deployed from a recreational vehicle (RV) or camper 104. The retractable awning 102 is attached to RV/camper 104 in a manner that is well known in the art. The retractable awning 102 has a roller tube 106 from which an awning canopy 108 is unrolled when being deployed, or onto which it is rolled when being retracted. The roller tube 106 also acts as an awning beam providing structural support to the leading edge 114 of the awning canopy 108. The awning canopy 108 is supported by bracing members 110*a* and 110*b*, which run parallel with the outside edges of the awning canopy 108 to provide rigidity to the canopy 108 when it is fully extended. The retractable awning 102 also includes support members 112*a* and 112*b* that support the leading edge 114 and awning beam 106 of the retractable awning 102.

As illustrated in FIG. 1, one of the support members 112*a* is deployed such that it is shorter than support member 112*b*, thereby causing the awning canopy 108 to tilt toward the lower corner 116 of the retractable awning 102. The support members 112*a, b* are typically designed to adjust in length by any of a number of known techniques to allow the user to adjust the pitch of the awning canopy 108. An embodiment of a rainwater catch and diverter 100 of the present invention is shown deployed at the lower corner 116 of the awning 102. The rainwater catch and diverter 100 can be coupled to the front awning beam (e.g. roller tube 106) such that rain water shed from the top surface of the awning canopy 108 flows to the lower corner 116 and is then captured by the rainwater catch and diverter 100 of the invention. The rainwater is then diverted away from the perimeter of the awning by extended downspout 118. Details of the embodiments of the rainwater catch and diverter 100 of the invention will be set forth in detail below.

Figure 2:
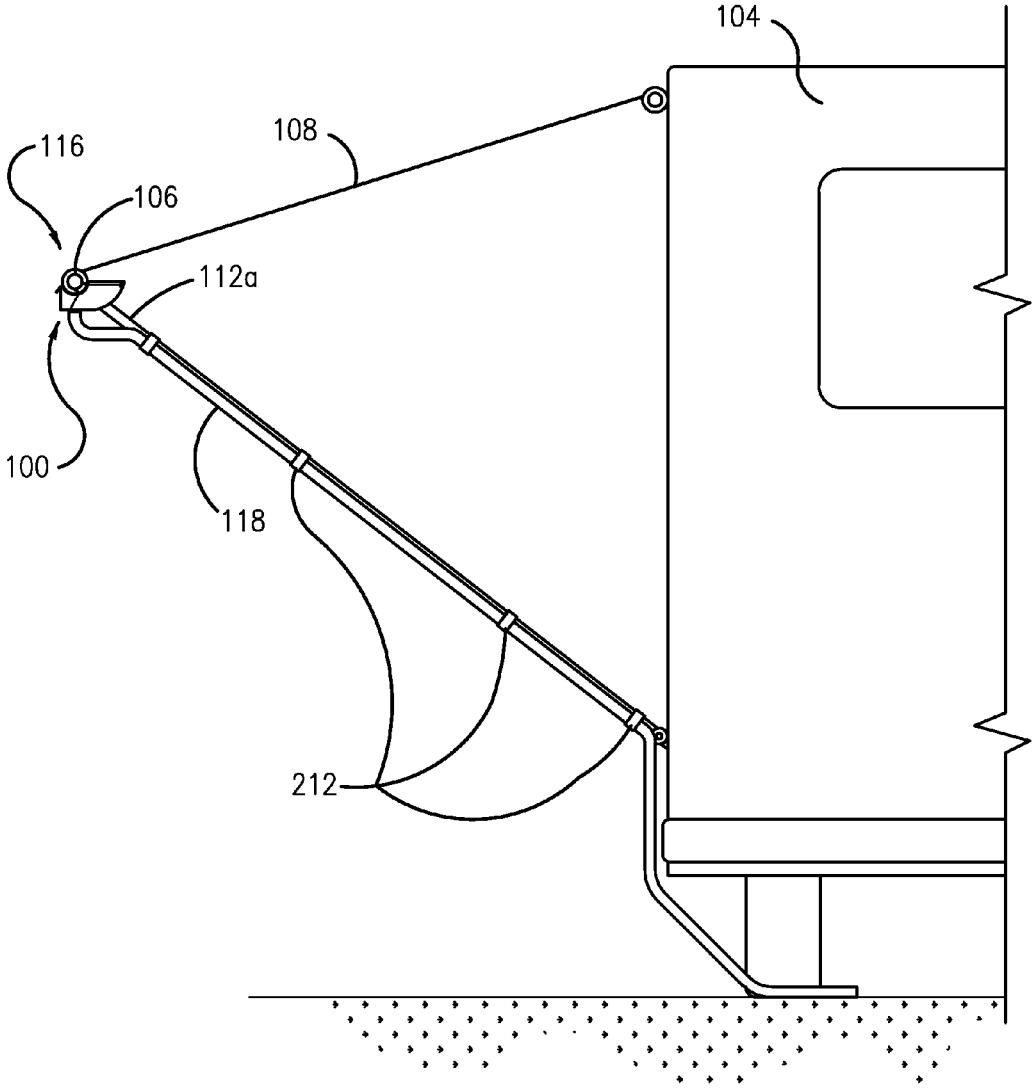
FIG. 2 is a side view of the retractable awning of FIG. 1, showing the lowered corner only, and showing an embodiment of the invention installed at the lower corner, and showing a downspout coupled to a support member of the retractable awning.

FIG. 2 is shows a side view of the retractable awning 102 of FIG. 1. For simplicity, only the lower corner 116 is shown. Extended downspout 118 can be coupled to the support arm 112*a* using, for example, Velcro straps, plastic ties, or other known techniques 212. It should be noted that it is common for support members 112*a* and 112*b* to have the capability to be deployed in a carport style configuration as well (not shown). In the carport configuration, support members 112*a,b* are extended perpendicularly to the ground. This permits easier access to the area under the awning canopy 108 from the sides. Support member 112*a* can still be made shorter than 112*b* to create the tilting of awning canopy 108 toward the rainwater catch and diverter 100 deployed on awning beam 106 at lower corner 116.

Figure 3:
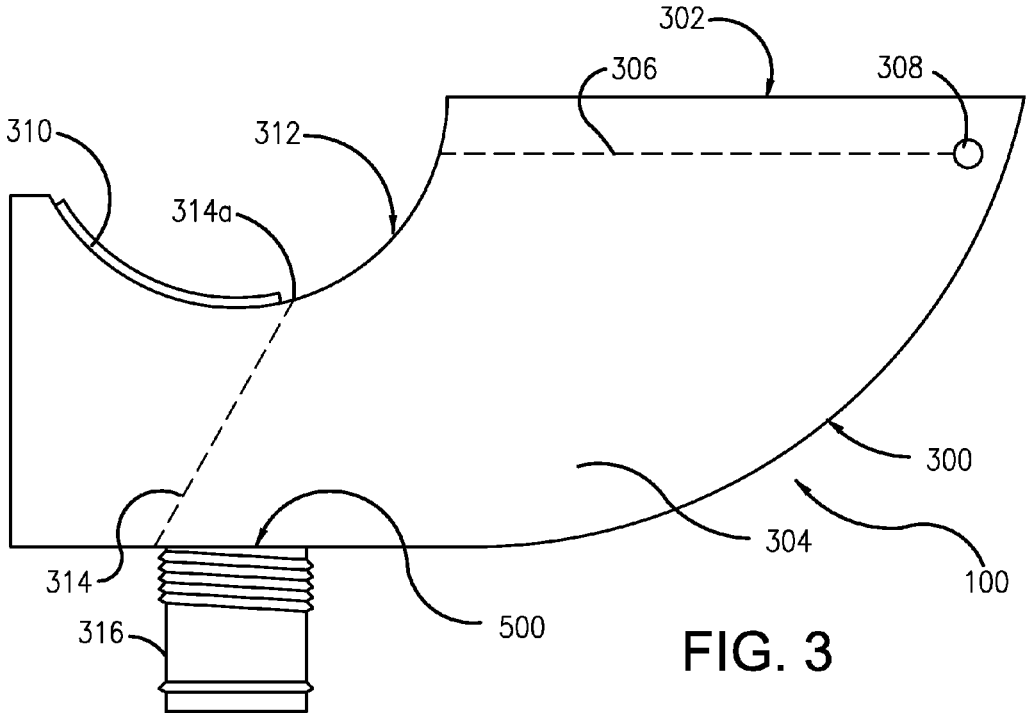
FIG. 3 is a side view of an embodiment of the invention.

FIG. 3 is a side view of an embodiment of the rainwater catch and diverter 100 of the invention. Rainwater flows from the surface of an awning canopy (108, FIGS. 1 and 2) into catch opening 302 and then into a cavity 304 formed by collector body 300. A debris guard 306 can be placed over the opening 302 in the collector body cavity 304, to prevent large debris such as twigs, leaves and the like from entering the collector body cavity 304. The debris guard 306 can be of any design suitable to permit water to flow readily there-through, while preventing larger forms of debris from collecting in the collector body cavity 304. The debris guard can be made of any suitable material, including but not limited to rigid plastic, nylon or metal.

In an embodiment, the collector body 300 can be made of a molded plastic or other suitable material, and can be curved at the front end to facilitate the flow of rainwater toward a downspout port 500, which is formed in the bottom of the collector body 300 toward the back end of the collector body 300. Downspout fitting 316 extends from the downspout port 500 and collector body 300, and can be threaded to receive an extended downspout (118, FIGS. 1 and 2) or other suitable attachments. An angled surface 314, formed within collector body cavity 304 can serve to direct collected rainwater that is flowing from the front of collector body 300 downward toward downspout port 500 to facilitate evacuation of the rainwater from the collector body cavity 304.

In an embodiment, collector body 300 further forms a beam collar 312, which is shaped to receive the awning beam 106 of the awning to which it will be attached. In the case of retractable awning 102 of FIGS. 1 and 2, the beam collar 312 can be radiused to meet the round shape of the roller tube 106 that forms the awning beam 106 for awning 102. A pad 310 can be deployed on the surface of the beam collar 312, made of material such as rubber, having a suitable coefficient of friction to resist rotational forces that will be created as water is collected at the front of the collector body 300. The beam collar 312 can be of any depth that will accommodate standard sized roller tubes, such that the opening 302 can be deployed at a level at or just below the top surface of awning canopy 108.

Figure 4:
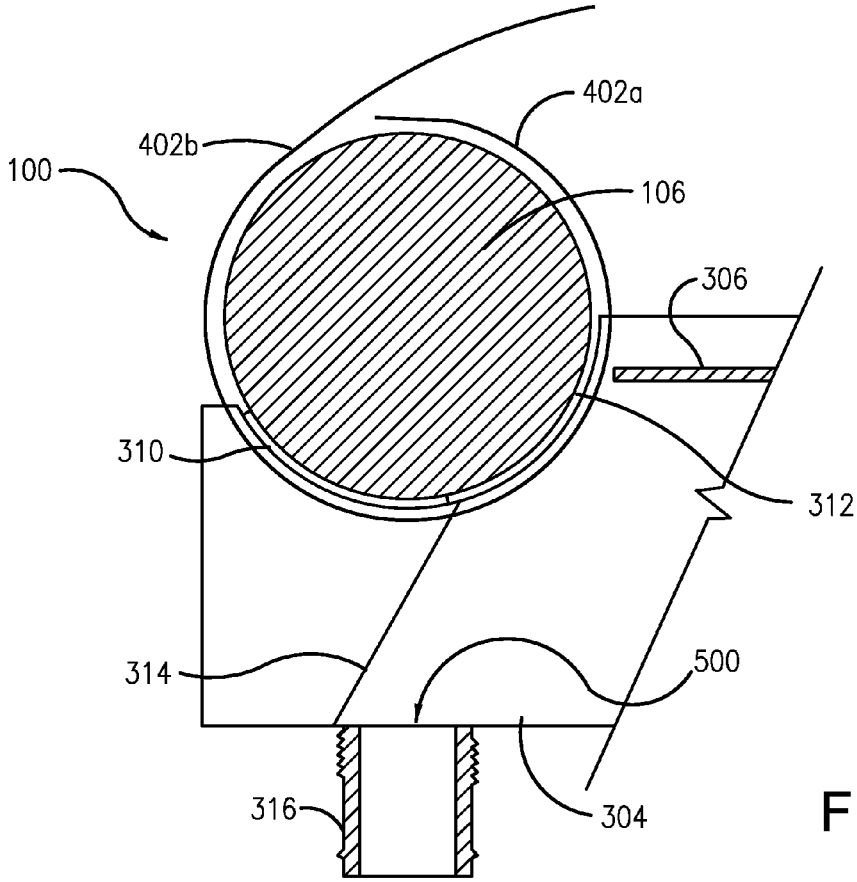
FIG. 4 is an abbreviated cross-sectional side view of an embodiment of the invention mounted on an awning beam.

FIG. 4 is an abbreviated cross-sectional side view of the rainwater catch and diverter 100 of FIG. 3, showing the beam collar 312 receiving the roller tube awning beam 106 of awning 102 (FIG. 1). In an embodiment, Velcro straps 402*a* and 402*b* can be used to secure the roller tube within beam collar 312, thereby providing a means for securing the rainwater catch and diverter 100 to the awning beam 106. It will be clear to one of ordinary skill that straps 402*a* and 402*b* can be two ends of the same strap, or can be two separate straps. It will also be clear that if, for example, strap or strap end 402*a* provides the hook mechanism of a typical Velcro fastening system, than strap or strap end 402*b* will provide the loop mechanism, or vice versa. Other means for securing the rainwater catch and diverter 100 to the awning beam can also be used, such as belt straps, ties and the like. Moreover, multiple sets of straps can be used, or one larger strap system can be employed.

It should be noted that other retractable awning designs, such as those employed in residential applications, typically have their roller tubes at the end of the awning that is attached to the building, rather than the leading edge 114 of the awning canopy. Thus, the awning canopy is unrolled from the attached end of the awning, instead of from the leading edge 114 as illustrated in FIG. 1. In this case, the awning beam 106 for the leading edge 114 of the awning canopy 108 may have any shape including round and rectangular. Thus, those of ordinary skill in the art will recognize that the beam collar 312 can be of any suitable shape, and of any suitable depth, to receive a standard awning beam 106 that is not a roller tube.

Figure 5:
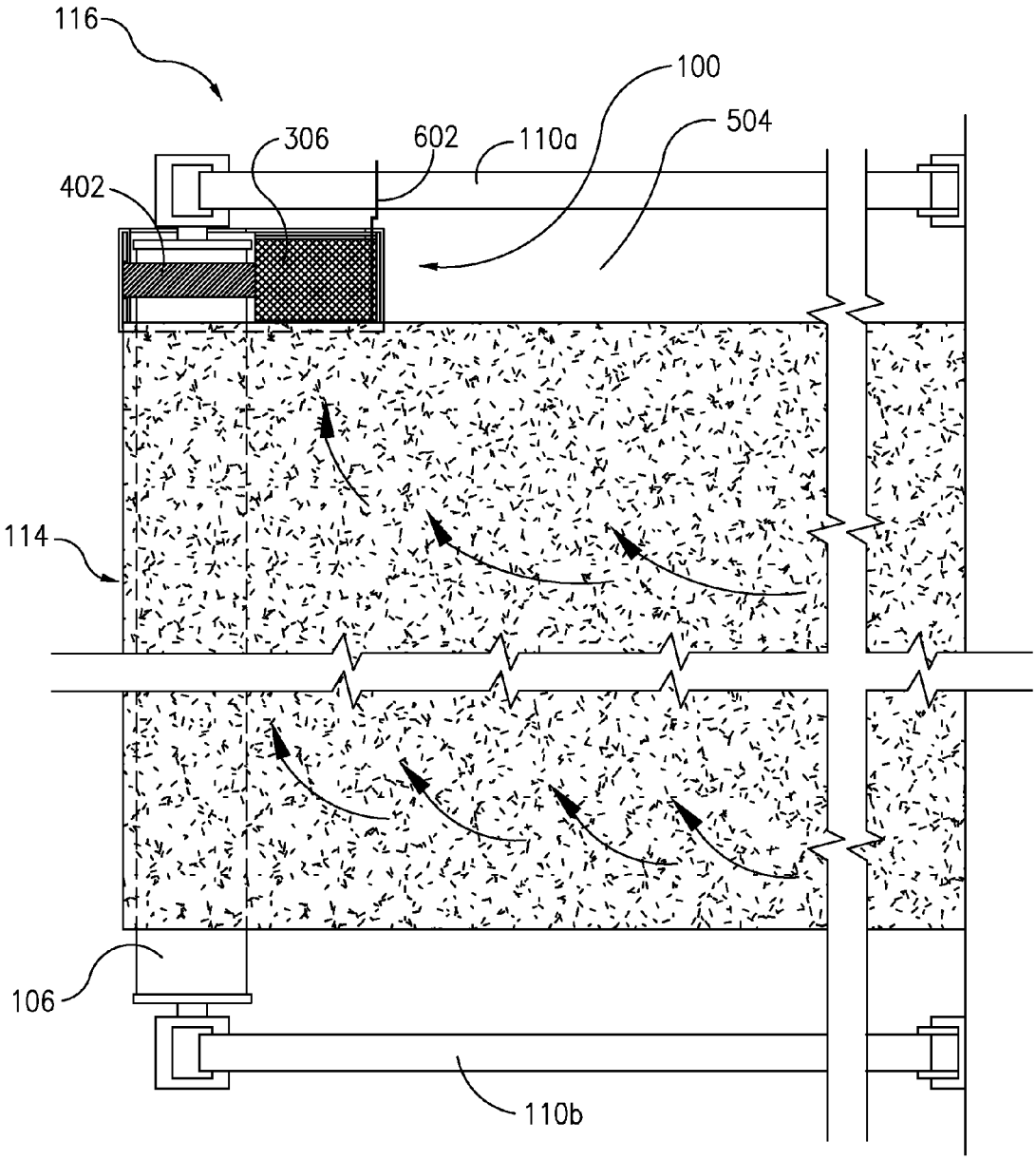
FIG. 5 is top view of the awning of FIG. 1 showing an embodiment of the invention mounted on the lower corner of the awning.

FIG. 5 is an abbreviated top view of the rainwater catch and diverter 100 deployed at lower corner 116 of retractable awning 102. Rainwater catch and diverter 100 is attached to awning beam 106 using Velcro strap 402. As previously mentioned, more than one set of straps can be used. Rainwater catch and diverter 100 can be attached to the awning beam such that catch opening 302 in body cavity 304 is disposed in space 504 between the edge of the awning canopy 108 and bracing member 110*a*. This gap or space 504 is common to most retractable awning designs. Catch opening 302 can also be positioned at or just below the level of the top surface of awning canopy 108, so water running off of the awning canopy 108 at the lowest corner 116 will easily flow into the body cavity 304 through the debris screen 306 and catch opening 302. Additional mounting support can be provided by mounting support 602, which can be inserted into mounting hole (308, FIG. 3) and then can rest on bracing member 110*a* to prevent clockwise rotation of rainwater catch and diverter 100 because of the higher weight at the front of the collector body 300 of rainwater catch and diverter 100 due to the collected rainwater that has not yet been evacuated from body cavity 304. Mounting support 602 can be made of any suitably resilient material, including metal, and can either have an end that rests on the bracing member surface, or can be clamped or otherwise affixed to the bracing member.

Figure 6:
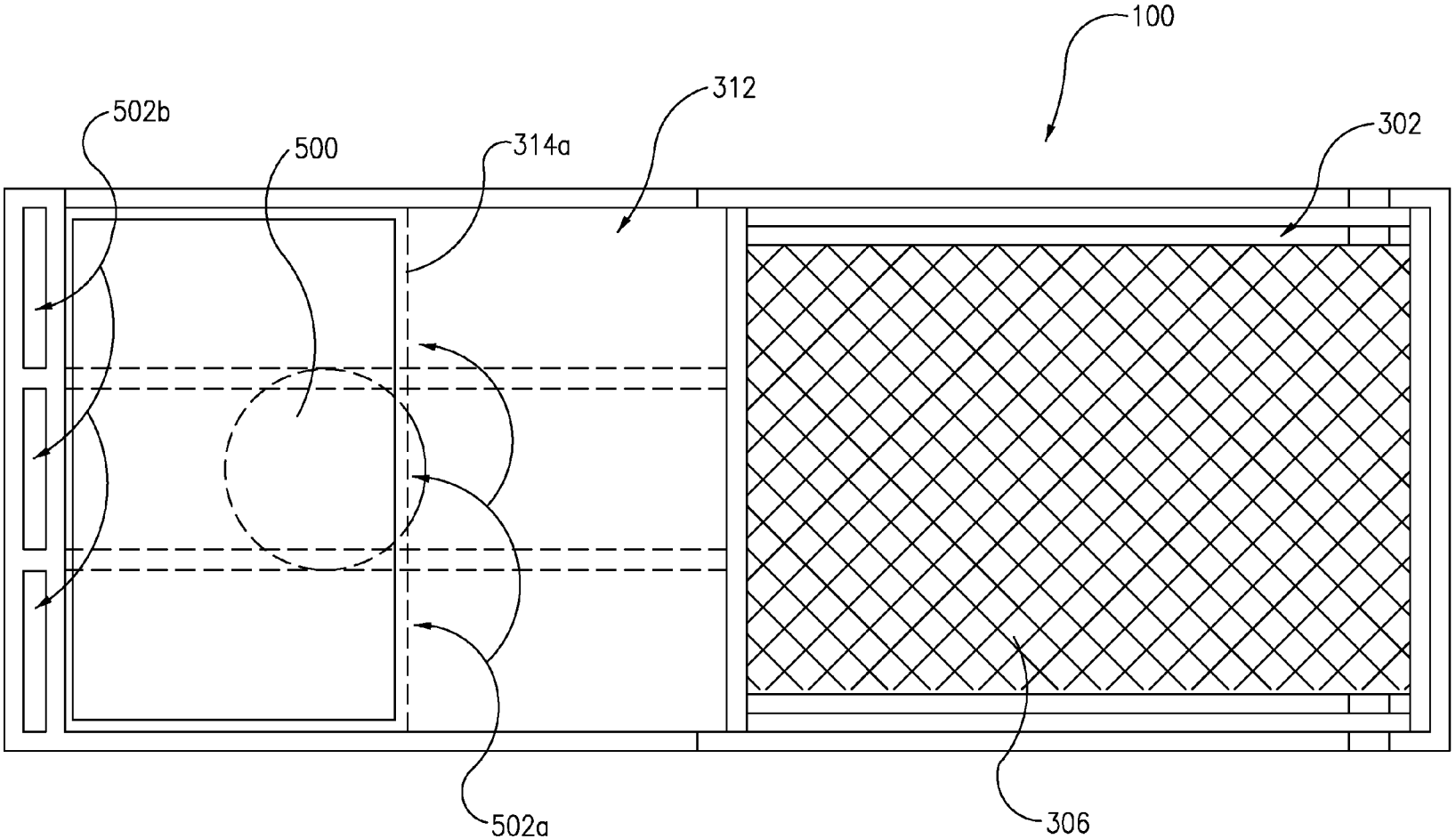
FIG. 6 is a top view of an embodiment of the invention.

FIG. 6 shows a top view of the rainwater catch and diverter 100. Gaps 502*a*, located just behind the leading edge 314*a* (i.e. on the dry side) of angled interior surface 314 (FIG. 3), provide an opening through which one or more Velcro straps or strap ends 402*a* can emerge from the collector body 300. Downspout port 500 is located under the angled interior surface 314 so that captured rainwater flowing toward the back of the collector body 300 will be driven down toward the downspout port 500 to facilitate efficient evacuation of the rainwater from collector body cavity 304. Gaps 502*b* provide openings through which Velcro straps or strap ends 402*b* emerge from the end of the collector 100.

Figure 7:
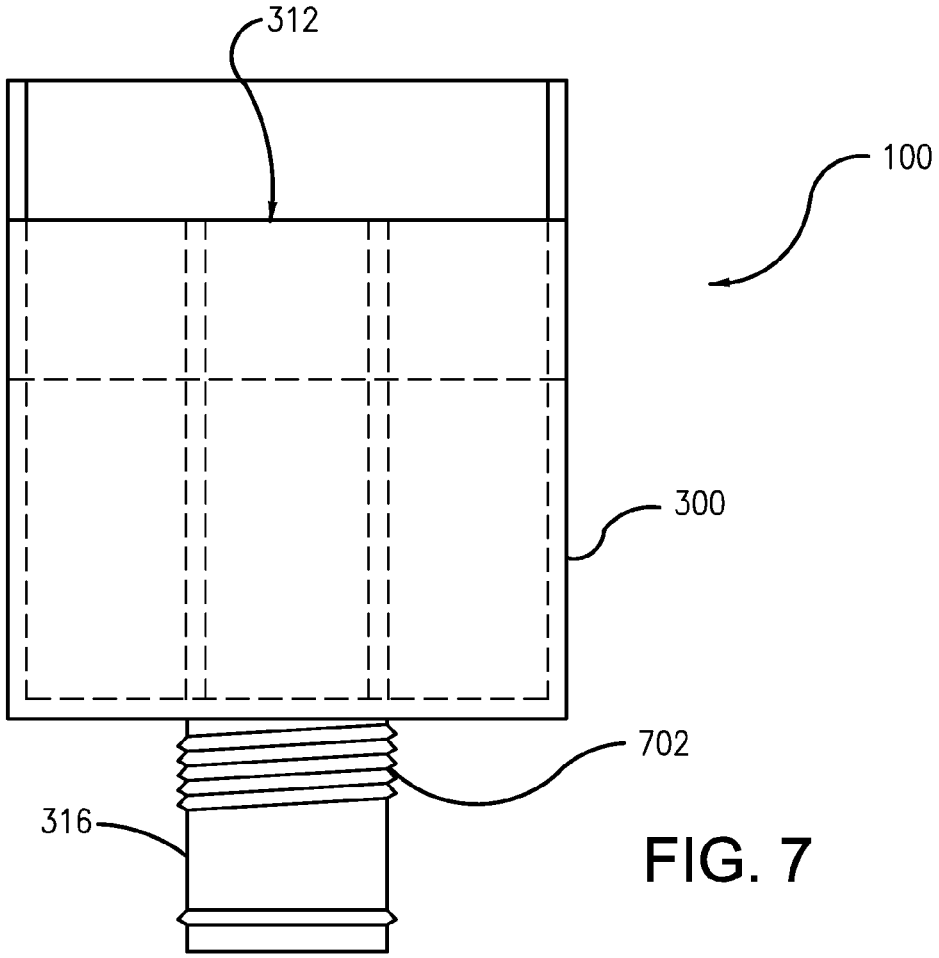
FIG. 7 is an end view of an embodiment of the invention, the viewed end being the one that is closest to the awning beam when mounted on an awning.
Figure 8:
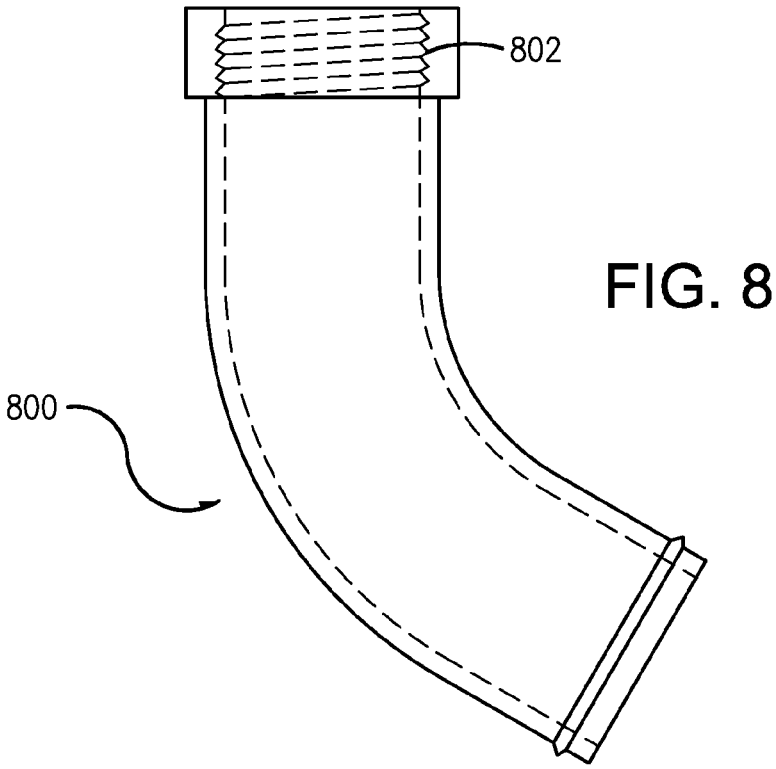
FIG. 8 is a side view of an elbow fitting that can be attached to a downspout port of an embodiment of the invention.

FIG. 7 shows an end view of the rainwater catch and diverter 100, illustrating the back end of the collector body 300 that would be facing out from the end of the awning 102. In an embodiment, downspout fitting 316 can have threads 702 for receiving and threading with an extended downspout 118, or which can also threadably receive a downspout elbow fitting 800 such as is illustrated in FIG. 8. Elbow fitting 800 can then couple to extended downspout 118 to direct the water evacuated from the collector cavity 304 and through the downspout port 500 away from the perimeter of the retractable awning 102 to which it is coupled.

Figure 9A:
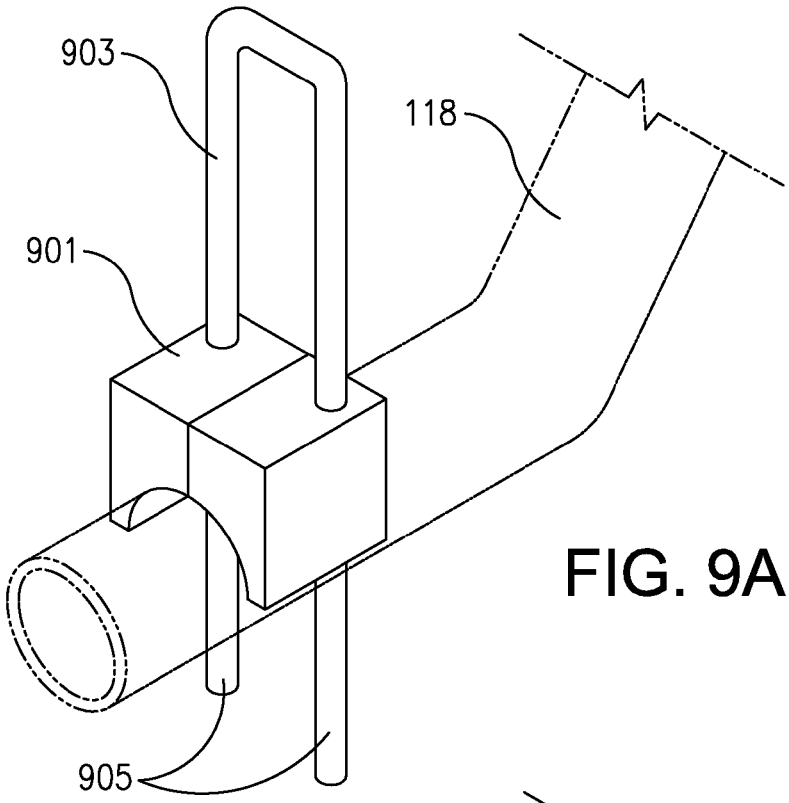
FIG. 9A is a perspective view of an embodiment of an anchoring means that can be deployed at the end that is closest to the ground, of an extended downspout coupled to an embodiment of the rain catch of the invention and that can be used to restrict movement of the extended downspout port.
Figure 9B:
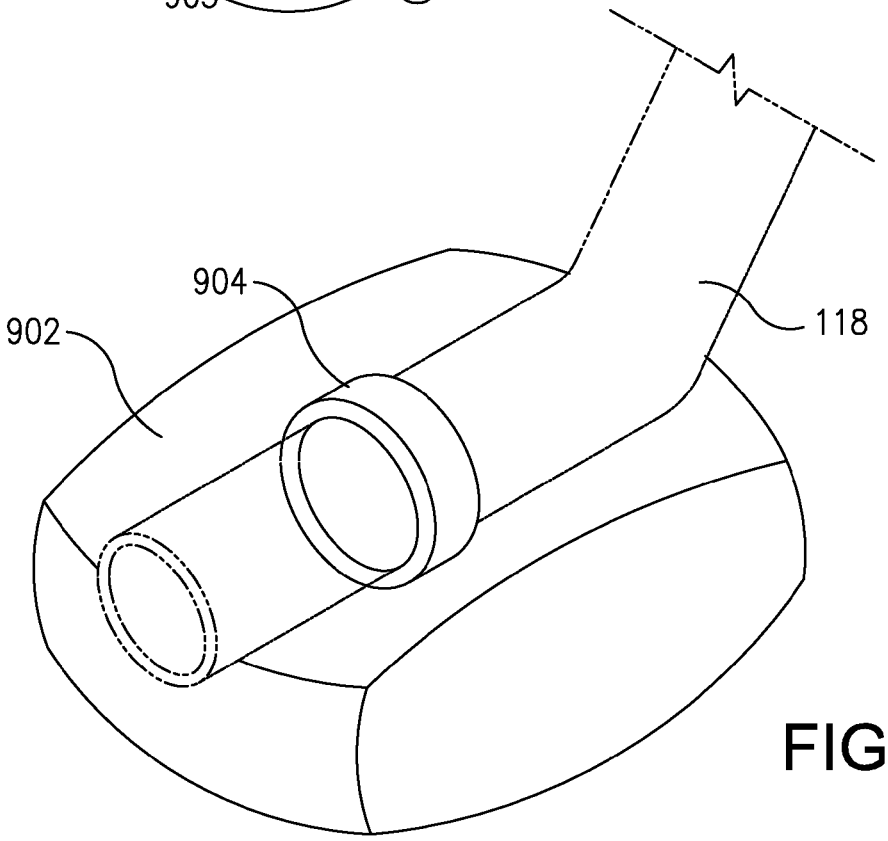
FIG. 9B is a perspective view of another embodiment of an anchoring means that can be deployed at the end that is closest to the ground, of an extended downspout coupled to an embodiment of the rain catch of the invention and that can be used to restrict movement of the extended downspout port.

FIGS. 9A and 9B illustrate embodiments of a means by which the extended downspout 118 can be immobilized at its end nearest the ground to prevent the force of the diverted rainwater, or other forces such as wind, from re-locating the end of the extended downspout to a less desirable location. FIG. 9A illustrates an embodiment that employs handle 903 to push legs 905 into the ground, forcing body 901 to receive and hold the extended downspout 118 to the ground.

FIG. 9B illustrates an embodiment that employs an anchoring member 902 having sufficient weight to resist the forces created by wind or the flow of the diverted rainwater. A retaining member 904, which is fixedly attached to the anchoring member 902, holds the extended downspout 118 in place. The anchoring member can be of a water resistant material, and can contain a filler such as sand to provide the weight necessary to anchor the extended downspout 118. The retaining member 904 can be a Velcro strap, plastic tie, a ring, a clamp, buckle, etc. that can be used to secure the extended downspout to the anchoring member 902. The retaining member can be fixedly attached to the anchoring member by any known suitable technique, including the use of an adhesive or being sewn into the anchoring member 902.

Other modifications and implementations will occur to those skilled in the art without departing from the spirit and the scope of the invention as claimed. Accordingly, the above description is not intended to limit the invention except as indicated in the following claims.

What is claimed is:

1. A rain catch for collecting and diverting rainwater from a retractable awning, the retractable awning having an awning beam supporting a leading downward edge of a pitched and tilted awning canopy, the awning canopy having a lowest corner, the awning canopy being able to direct rainwater towards the lowest corner, the rain catch comprising:

a collector body, the collector body defining;

an awning beam collar at a first end of the collector body and formed integrally therewith, the awning beam collar for receiving the awning beam, and a collector body cavity extending from underneath at least a portion of the awning beam collar to a second end of the collector body, the collector body cavity having a body cavity opening that extends from the awning beam collar to the second end of the collector body;

a securing means for coupling the collector body to the awning beam at the lowest corner of the awning canopy so that the body cavity opening extends upwardly along the edge of the awning canopy to receive rainwater flowing from the awning canopy, the securing means attached to the collector body and capable of creating a gripping force between the awning beam collar and the awning beam to resist rotation of the collector body around the awning beam; and a downspout port cooperative with the collector body and located substantially beneath the awning beam collar that allows received rainwater to flow from the collector body cavity through the downspout port and further through a downspout coupled thereto.

2. The rain catch of claim 1, wherein the securing means comprises at least one strap made of hook and loop material.

3. The rain catch of claim 1, further comprising an angled downspout coupled to the downspout port, the angled downspout being able to direct received rainwater away from the retractable awning.

4. The rain catch of claim 1, further comprising an extended downspout coupled to the downspout port, the extended downspout being able to direct received rainwater away from the retractable awning.

5. The rain catch of claim 4, further comprising means for substantially immobilizing the extended downspout at an end closest to the ground.

6. The rain catch of claim 5 wherein the means for substantially immobilizing the extended downspout includes:

a body filled with sand; and a means, coupled to the body, for securing the extended downspout to the body filled with sand.

7. The rain catch of claim 1 wherein:

the collector body further comprises a mounting hole located at the second end; and a mounting support having one end inserted in the mounting hole and the other end in physical communication with a bracing member of the retractable awning to resist rotation of the collector body around the awning beam.

8. The rain catch of claim 1, wherein the awning beam collar includes a pad made of a material able to increase frictional force between the beam collar and the awning beam to further resist rotation of the collector body about the awning beam.

9. The rain catch of claim 1, wherein the collector body and the collector body cavity are curved at the second end to direct rainwater flow back toward the downspout port.

10. The rain catch of claim 9, wherein the collector body cavity further includes an angled surface emanating at the first end from behind the downspout port and angling upwardly and over the downspout port that can re-direct received rainwater, that is flowing past the downspout port from the second end of the collector body cavity, downwardly and back towards the downspout port.

11. A rain catch for collecting and diverting rainwater from a retractable awning, the retractable awning having an awning beam supporting a leading downward edge of a pitched and tilted awning canopy, the retractable awning further having at least one bracing member substantially perpendicular to the awning beam at a side of the awning canopy, having a lowest corner, the awning canopy being able to direct rainwater towards the lowest corner, the rain catch comprising:

a collector body, the collector body defining a collector body cavity having a body cavity opening;

an awning beam collar for receiving the awning beam, the awning beam collar disposed at a back end of the collector body and formed integrally therewith, the collector body cavity extending from under at least a portion of the awning beam collar, the collector body cavity and the body cavity opening extending substantially forward of the awning beam collar to form a front end;

means for securing the collector body to the awning beam, the means for securing producing a gripping force between the awning beam collar and the awning beam to resist rotation of the collector body around the awning beam; and a downspout port proximately located toward the back end of the collector body cavity and able to couple to a downspout, the downspout port configured to allow received rainwater to flow from the collector body cavity, through the downspout port, and out of the downspout;

wherein the collector body can be coupled to the awning beam at the lowest corner of the awning canopy, such that the body cavity opening extends substantially into a space between the edge of the awning canopy and the at least one bracing member, the body cavity opening being able to receive rainwater flowing off of the edge of the awning canopy extending from the lowest corner of the awning canopy.

12. The rain catch of claim 11, further comprising an extended downspout coupled to the downspout port, the extended downspout being able to direct rainwater flow away from the retractable awning.

13. The rain catch of claim 12, further comprising means for substantially immobilizing the extended downspout at an end closest to the ground.

14. The rain catch of claim 11 wherein:

the collector body further comprises at least one mounting hole located substantially at the front end of the collector body; and a mounting support having one end inserted in the at least one mounting hole and the other end in physical communication with the at least one bracing member to further resist rotation of the collector body around the awning beam.

15. The rain catch of claim 11, wherein the awning beam collar includes a pad made of a material able to increase frictional force between the beam collar and the awning beam to further resist rotation of the collector body about the awning beam.

16. The rain catch of claim 11, wherein the collector body and the collector body cavity are curved at the front end to direct rainwater flow toward the back end of the collector body cavity and the downspout port.

17. The rain catch of claim 16, wherein the collector body cavity further includes an angled surface located substantially at the back end of the collector body cavity, emanating from behind, and extending over, the downspout port, that can re-direct received rainwater that is flowing past the downspout port from the front of the collector body cavity, downwardly and back towards the downspout port.

18. A rain catch for collecting and diverting rainwater from a retractable awning, the retractable awning having an awning beam supporting a leading downward edge of a pitched and tilted awning canopy, the awning canopy having a lowest corner, the awning canopy being able to direct rainwater toward the lowest corner, the rain catch comprising:

a collector body, the collector body defining a collector body cavity and an awning beam collar for receiving the awning beam, the awning beam collar located substantially at a back end of the collector body, the collector body cavity extending out from under the awning beam collar to form a front end, the collector body further having a cavity opening extending from the awning beam collar to the front end that is able to receive rainwater flowing off the edge of the awning canopy extending from the lowest corner of the awning canopy;

means for securing the collector body to the awning beam such that the body cavity opening extends along the edge of the awning canopy and substantially in the same plane therewith, the collector body further having at least one mounting hole located substantially at the front end of the collector body and a mounting support having one end inserted in the at least one mounting hole and the other end in physical communication with a bracing member to further resist rotation of the collector body around the awning beam; and a downspout port cooperative with the collector body, the downspout port located substantially under the beam collar and being able to allow received rainwater to flow out from the collector body cavity and through the downspout port.

* * * * *